US007967473B2

(12) United States Patent
Huang et al.

(10) Patent No.: US 7,967,473 B2
(45) Date of Patent: Jun. 28, 2011

(54) LED LAMP WITH HEAT SINK

(75) Inventors: Chung-Yuan Huang, Santa Clara, CA (US); Jer-Haur Kuo, Taipei Hsien (TW); Xin-Xiang Zha, Shenzhen (CN); Ye-Fei Yu, Shenzhen (CN); Lin Yang, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 439 days.

(21) Appl. No.: 12/147,521

(22) Filed: Jun. 27, 2008

(65) Prior Publication Data

US 2009/0268463 A1 Oct. 29, 2009

(30) Foreign Application Priority Data

Apr. 25, 2008 (CN) ..... 2008 1 0066799

(51) Int. Cl.
*F21V 29/00* (2006.01)

(52) U.S. Cl. ..... 362/294; 362/153.1; 362/218; 362/249.02; 362/264; 362/345; 362/373

(58) Field of Classification Search ..... None
See application file for complete search history.

(56) References Cited

U.S. PATENT DOCUMENTS 7,025,125 B2 * 4/2006 Sheng et al. ..... 165/104.33
7,278,761 B2 * 10/2007 Kuan ..... 362/294
7,338,186 B1 * 3/2008 Wu et al. ..... 362/294

FOREIGN PATENT DOCUMENTS

CN 200952670 Y 9/2007
CN 200965218 Y 10/2007

* cited by examiner

*Primary Examiner* — Sharon E Payne
(74) *Attorney, Agent, or Firm* — Frank R. Niranjan

(57) ABSTRACT

An LED lamp (100) includes a plurality of LED modules (20) and a thermal module (30). Each of the LED modules has a plurality of LEDs (220). The thermal module is secured to a side of the LED modules. The thermal module includes a plurality of fins (320). The fins are stacked with one above another with a gap defined between two adjacent fins. Each of the fins defines two opening (325). The openings of the fins coincide with each other from top to bottom so as to form two channels (328). The channels are used for air to flow therein to exchange heat with the fins.

18 Claims, 7 Drawing Sheets

LED LAMP WITH HEAT SINK

BACKGROUND

1. Field of the Invention

The present invention relates to a light emitting diode (LED) lamp, and more particularly to an LED lamp incorporating a heat sink for dissipating heat generated by the LED lamp.

2. Description of Related Art

As an energy-efficient light, an LED lamp has a trend of substituting for the fluorescent lamp for a lighting purpose. In order to increase the overall lighting brightness, a plurality of LEDs are often incorporated into a lamp. It is well known that the LEDs generate a lot of heat when emitting heat. If the heat cannot be quickly removed, the LED lamp may be overheated, significantly reducing work efficiency and service life thereof. Therefore, how to efficiently dissipate the heat of the LEDs becomes a challenge for the LED lamp.

What is needed, therefore, is an LED lamp having a heat sink which can efficiently dissipate the heat of the LEDs.

SUMMARY

An LED lamp includes a plurality of LED modules and a thermal module. Each of the LED modules has a plurality of LEDs. The thermal module is secured to a side of the LED modules. The thermal module includes a plurality of fins. The fins are stacked with one above another with a gap defined between two adjacent ones. Each of the fins defines two openings. The openings of the fins coincide with each other from top to bottom so as to form two channels. The channels are used for air to flow therein to exchange heat with the fins.

Other advantages and novel features of the present invention will become more apparent from the following detailed description when taken in conjunction with the accompanying drawings.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
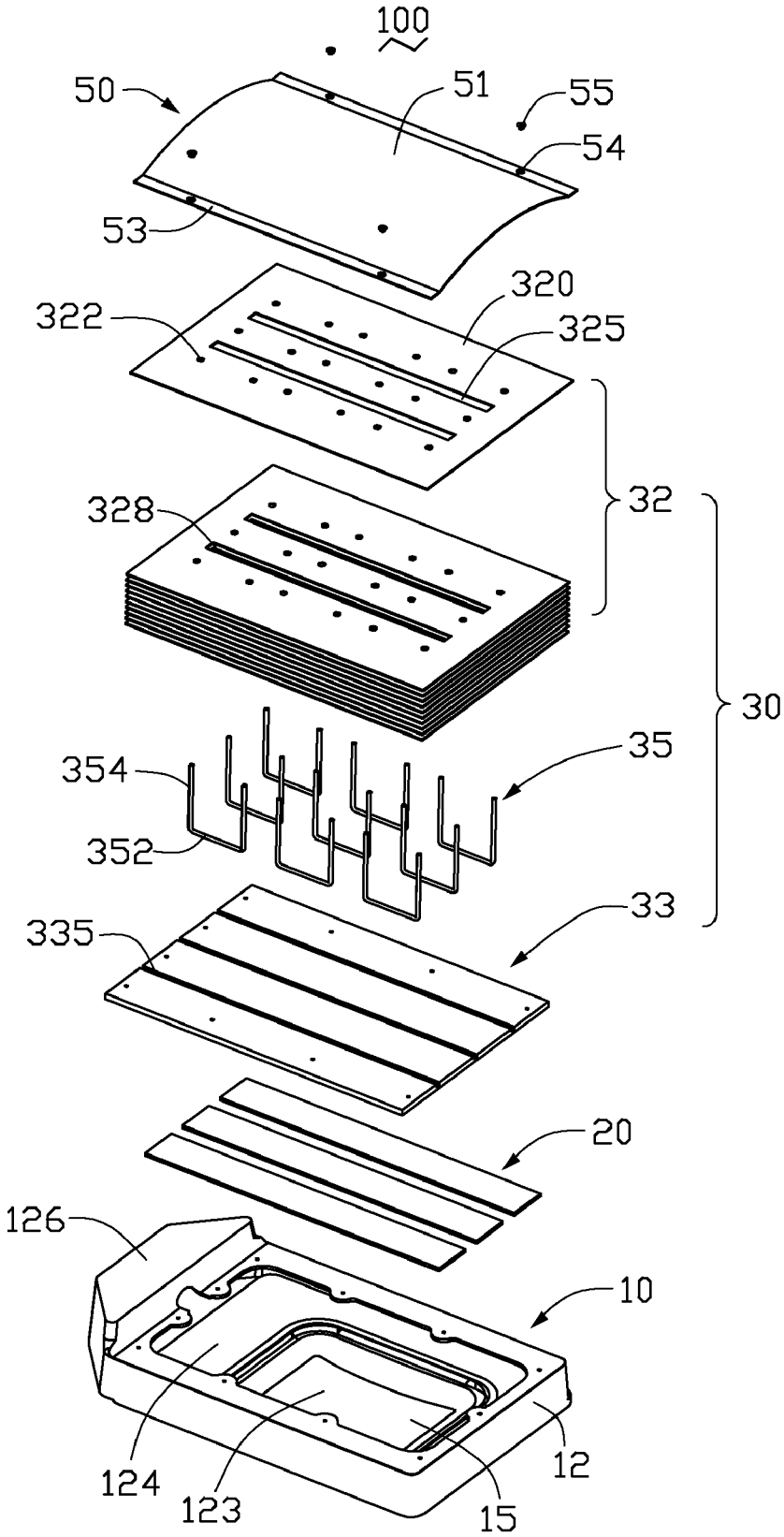
FIG. 1 is an exploded, isometric view of an LED lamp with a heat sink in accordance with an embodiment of the present invention.
Figure 2:
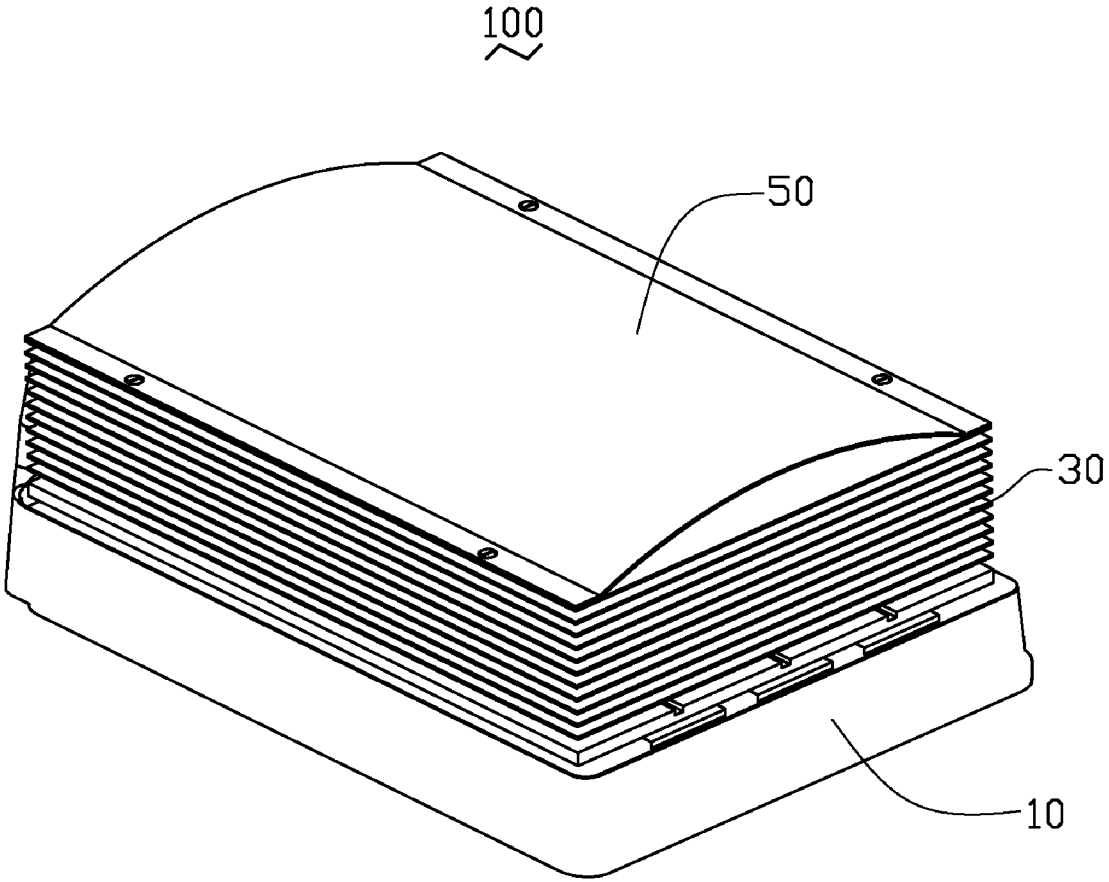
FIG. 2 is an assembled, isometric view of the LED lamp shown in FIG. 1.

Referring to FIGS. 1 and 2, an LED lamp 100 in accordance with an embodiment of the present invention is shown.

The LED lamp 100 comprises a lamp enclosure 10, a plurality of LED modules 20, a thermal module 30 and a cover 50. The LED modules 20 are received in the lamp enclosure 10 for generating light. The thermal module 30 is attached to a top portion of the lamp enclosure 10 and contacts the LED modules 20 for dissipating heat generated by the LED modules 20. The cover 50 is mounted over the thermal module 30 for covering the thermal module 30.

The lamp enclosure 10 has a rectangular casing 12 and a lens 15. The lens 15 is attached to a bottom of the casing 12. The casing 12 comprises a connecting portion 126 extending from a lateral side thereof. The casing 12 and the lens 15 cooperatively define a room 123 for receiving the LED modules 20 therein. The casing 12 has an opening 124 in a top thereof. The LED modules 20 can enter the room 123 through the opening 124.

Figure 3:
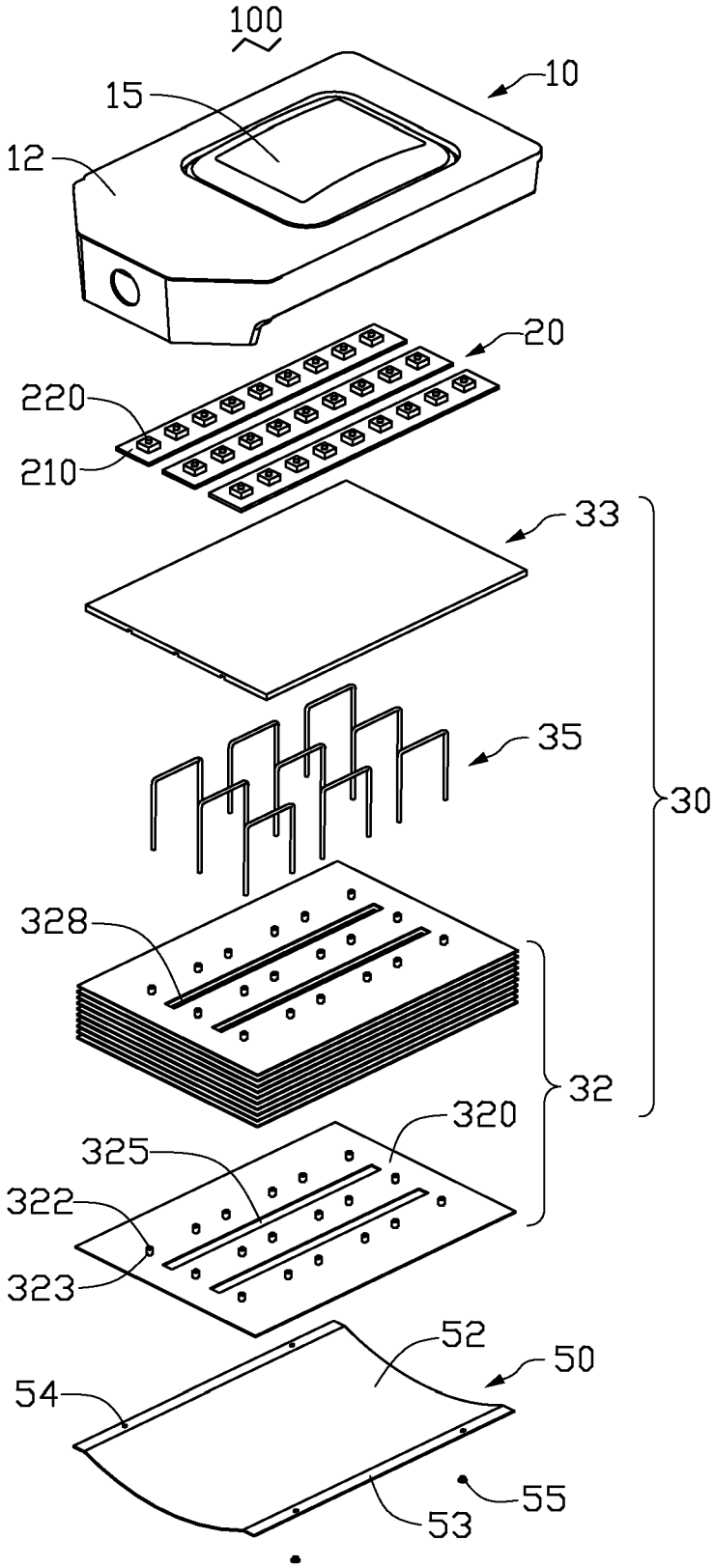
FIG. 3 is a view similar to FIG. 1, but viewed from an opposite bottom aspect.

Also referring to FIG. 3, each of the LED modules 20 comprises a substrate 210 having a rectangular shape, and a plurality of LEDs 220 equidistantly mounted on the substrate 210. Preferably, the substrate 210 is a printed circuit board. The LED modules 20 space from each other in a uniform interval.

The thermal module 30 comprises a heat sink 32, a base 33 and a plurality of heat pipes 35. The heat sink 32 comprises a plurality of rectangular fins 320. The fins 320 are stacked with one above another with a gap defined between two adjacent ones. Two elongated openings 325 are defined in each of the fins 320. The openings 325 are parallel to each other. The openings 325 are rectangular and extend along a longitudinal direction of the fin 320. The openings 325 of the fins 320 coincide with each other from top to bottom, thereby forming two vertical channels 328. The channels 328 communicate air above the heat sink 32 with air below the heat sink 32. Each of the fins 320 has a plurality of circular holes 322, which are arranged in three parallel rows. Either of the two openings 325 is located between two adjacent rows of the holes 322. The openings 325 and the holes 322 are formed by stamping corresponding parts of the fin 320. A plurality of flanges 323 extends from a surface of each fin 320. Each of the flanges 323 corresponds to one of the holes 322 for enclosing a peripheral edge of the corresponding hole 322. The fins 320 are equidistantly spaced from each other via the flanges 323 abutting against an adjacent fin 320. The holes 322 of the fins 320 coincide with each other from top to bottom, thereby forming a plurality of circular channels (not labeled) for engagingly receiving the heat pipes 35 therein.

The base 33 is attached to a top portion of the casing 12. The base 33 is made of a material having good heat conduction, such as copper or aluminum. The base 33 has a top surface shown in FIG. 1, which is rectangular and has a size similar to that of each of the fins 320. The top surface of the base 33 spaces from a bottom of the heat sink 32. The top surface of the base 33 defines three grooves 335 therein. The grooves 335 are parallel to each other and respectively correspond to the rows of holes 322. The LED modules 20 are attached to a bottom surface of the base 33, thereby to be received in the room 123 of the lamp enclosure 10 and face the lens 15.

Each of the heat pipes 35 is bended to have a generally U-shaped configuration. Each heat pipe 35 has a horizontal evaporator 352 and two vertical condensers 354. The two condensers 354 are respectively connected to two ends of the evaporator 352. A vertical length of the condenser 354 of each heat pipe 35 is longer than a vertical length of the heat sink 32. The evaporators 352 of the heat pipes 35 are conformably received in the grooves 335 of the base 33. The condensers 354 of the heat pipes 35 extend through the holes 322 of the fins 320 so as to assemble the fins 320 together to form the heat sink 32. The heat pipes 35, the base 33 and the heat sink 32 are assembled together by soldering.

The cover 50 is made of light metal which has good heat conduction, such as aluminum. The cover 50 has an arced shape and provides a shielding area covering a whole top portion of the heat sink 32 of the thermal module 30. The cover 50 has an outer surface 51 having a convex shape and an internal surface 52 having a concave shape. Both of the outer surface 51 and the internal surface 52 are smooth. Two opposite, lateral edges 53 of the cover 50 are bent to have a horizontal shape. Either of the lateral edges 53 defines two spaced holes 54 therethrough. Screws 55 extend through the holes 54 to threadly engage with a top portion of the heat sink 32, thereby securing the cover 50 to the heat sink 32. The internal surface 52 spaces from the top portion of the heat sink 32.

Figure 4:
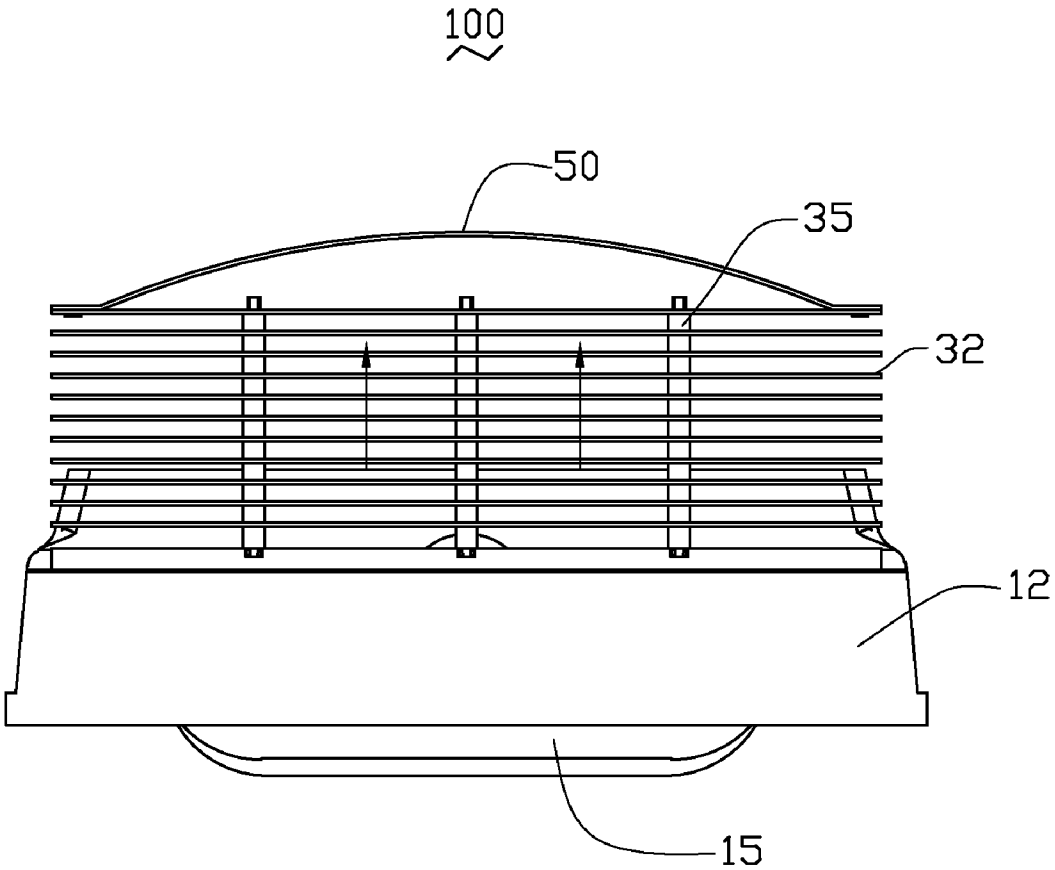
FIG. 4 is a right side view of the LED lamp shown in FIG. 2.

Referring to FIG. 4, in operation, heat generated by the LED module 20 is firstly absorbed by the base 33, then a portion of the heat of the base 33 is transferred to the heat pipes 35, and further conducted to the fins 320 of the heat sink 32. Another portion of the heat of the base 33 is transferred to air between the bottom of the heat sink 32 and the base 33. Furthermore, the heated air floats upwardly through the vertical channels 328 of the heat sink 32, and exchange heat with the fins 320 and ambient cool air. The vertical channels 328 provide a smooth passage for the heated air to disperse upwardly and contact with the fins 320. Thus, a heat dissipation efficiency of the thermal module 30 can be improved. The cover 50 shields the top of the heat sink 32 so that dust, snow or ice piling up the fins 320 can be greatly reduced. Furthermore, heat generated by the LED modules 20 can be transferred to the cover 50 via the heat pipes 35 and the topmost fin 320 so as to enhance heat dissipating efficiency by utilizing a large area of the cover 50. Moreover, the cover 50 is spaced from the heat sink 32 so that the heat sink 32 can disperse the heat to an ambient air more quickly.

Figure 5:
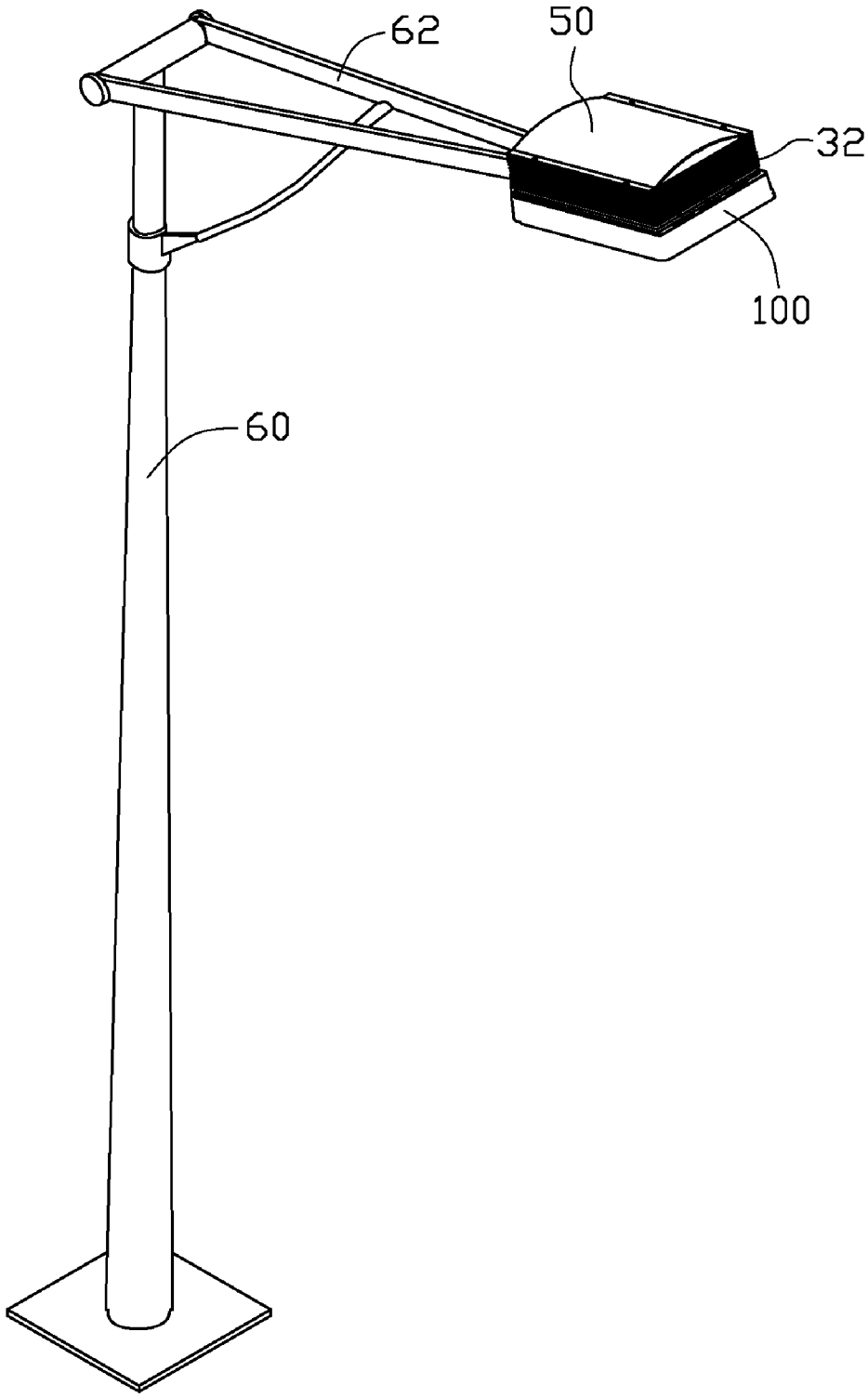
FIG. 5 is an assembled, isometric view of the LED lamp shown in FIG. 2 and a lamp post.

Please referring to FIG. 5, the LED lamp 100 is connected to a lamp post 60 so as to form a street lamp. An arm 62 extends from a top of the lamp post 60 to a lateral side. The arm 62 is connected to the connecting portion 126 of the LED lamp 100 so that the LED lamp 100 is fixedly supported by the lamp post 60.

Figure 6:
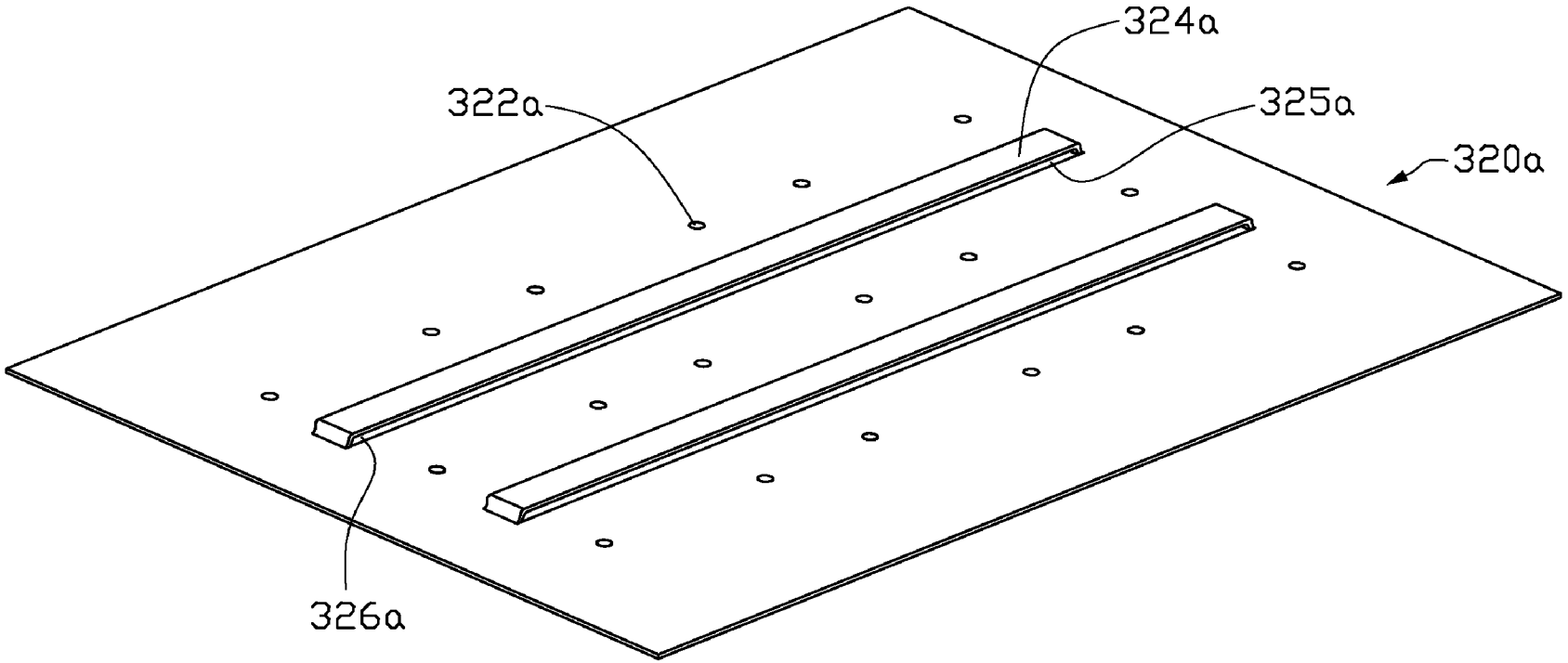
FIG. 6 is an isometric view of another fin which can be used in the heat sink of the LED lamp shown in FIG. 1.
Figure 7:
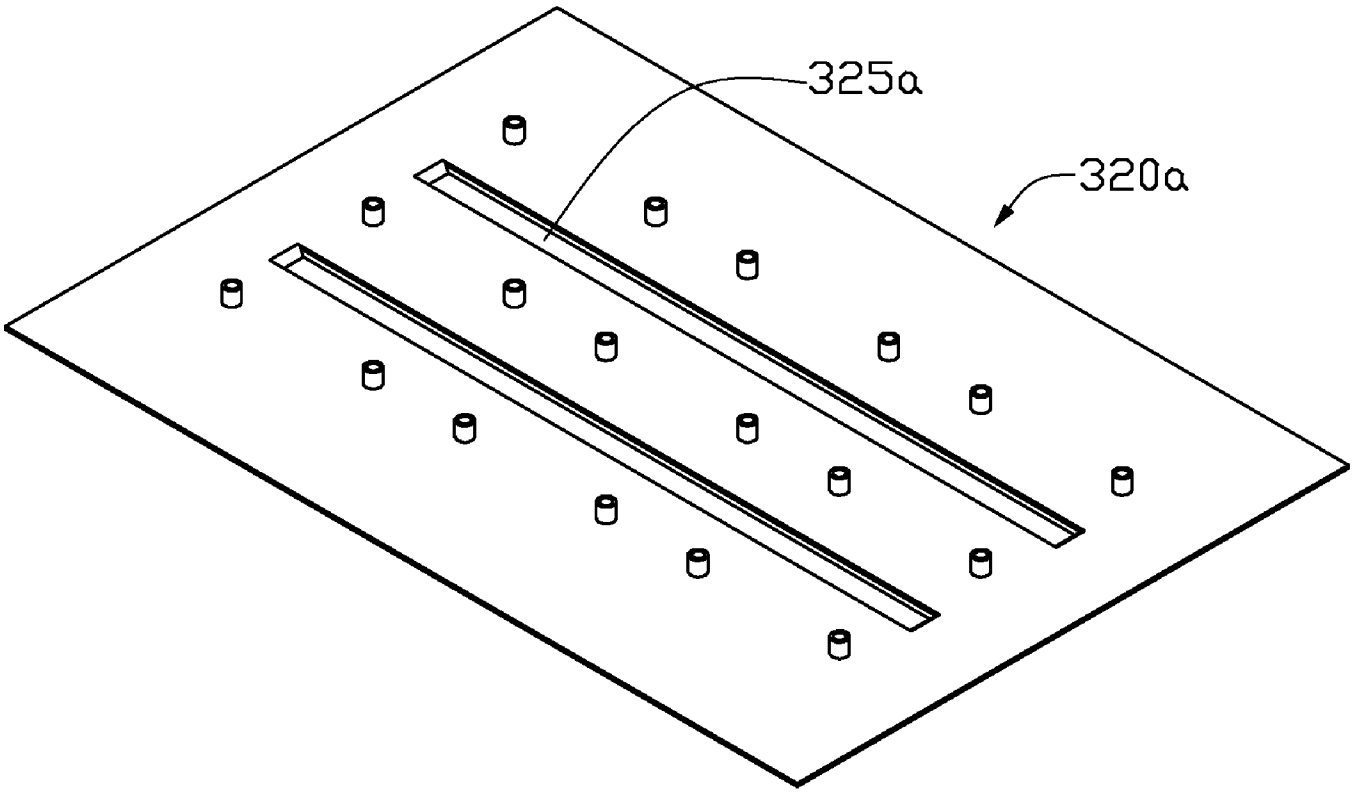
FIG. 7 is a view similar to FIG. 6, but viewed from an opposite bottom aspect.

In an alternative embodiment, other fins with different shapes can also be used in the heat sink 32. Referring to FIG. 6 and FIG. 7, a fin 320*a* which can be used in the heat sink 32 is shown. The fin 320*a* has a similar configuration to the fin 320. Similarly, the fin 320*a* includes a plurality of holes 322*a* for receiving the heat pipes 32 and two openings 325*a* for forming channel. The difference between the fin 320*a* and the fin 320 is that two tabs 324*a* protrude from a surface of the fin 320*a*. Either of the tabs 324*a* is formed adjacent to one of the openings 325*a* by stamping a corresponding part of the fin 320*a*. Either of the tabs 324*a* has an elongated, rectangular shape. Two opposite ends of either tab 324*a* are connected to the fin 320*a*. Either of the openings 325*a* includes two narrow spaces 326*a* locating at two lateral sides of the corresponding tab 324*a*. Air located at two opposite sides of the fin 320*a* can communicate with each other through the opening 325*a* and the spaces 326*a*.

In a heat sink assembled by the fins 320*a*, heated airflow below each of the fins 320*a* passes through the openings 325*a* and impinges on the corresponding tabs 324*a*. On one hand, the heated airflow rebounds so as to create turbulence of air near the tabs 324*a*. Thus, the airflow has more chances to contact the tabs 324*a* and exchange more heat with the tabs 324*a*. On the other hand, the tabs 324*a* conduct the airflow to flow horizontally along surfaces of the fins 320*a* so that a boundary layer or interfacial layer of the surfaces of the fins 320*a* can be destroyed by the horizontal airflow; accordingly, the airflow has more chances to exchange heat with the fins 320*a*. Thus, a heat dissipation efficiency of the heat sink can be enhanced. The heated airflow also can pass through the spaces 326*a* and float upwardly. Alternatively, a similar tab can extend slantingly from the fin 320*a* and has a free end, thereby forming an oblique wall to the airflow.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

at least one LED module having a plurality of LEDs; and a thermal module being secured to a side of the at least one LED module;

wherein the thermal module comprises a plurality of fins, the fins are stacked with one above another with a gap defined between two adjacent ones, each of the fins defines at least one opening, the openings of the fins coincide with each other from top to bottom so as to form a channel, the channel is used for air to flow therein to exchange heat with the fins;

wherein each of the fins comprises at least one tab, and the at least one tab protrudes from a surface of the each of the fins; and wherein the at least one tab is formed adjacent to the at least one opening, and two opposite ends of the at least one tab are connected to the each of the fins.

2. The LED lamp as claimed in claim 1, wherein the at least one opening is elongated and rectangular.

3. The LED lamp as claimed in claim 1, wherein the at least one opening has a number more than one, and the openings of each of the fins are spaced from and parallel to each other.

4. The LED lamp as claimed in claim 1, wherein the thermal module further comprises a base and a plurality of heat pipes, the base is attached to a surface of the at least one LED module, the heat pipes connect the base with the fins.

5. The LED lamp as claimed in claim 4, wherein each of the heat pipes comprises a evaporator and two condensers, the condensers are vertically connected to two ends of the evaporator, the evaporator is attached to the base, the condensers extend through the fins so as to assemble the fins together to form a heat sink.

6. The LED lamp as claimed in claim 5, wherein the fins defines a plurality of holes corresponding to the condensers of the heat pipes, the at least one opening is located between the holes.

7. The LED lamp as claimed in claim 5 further comprising a cover, wherein the cover shields a top portion of the heat sink.

8. The LED lamp as claimed in claim 7, wherein the cover has an arced shape, the cover has an outer surface having a convex shape and an internal surface having a concave shape.

9. The LED lamp as claimed in claim 8, wherein the internal surface of the cover spaces from the top portion of the heat sink.

10. The LED lamp as claimed in claim 1, wherein the air flows upwardly through the openings and impinges on the tabs to flow horizontally along the surfaces of the fins.

11. The LED lamp as claimed in claim 1, wherein the at least one opening comprises two narrow spaces located at two lateral sides of the at least one tab.

12. A street lamp comprising:

a lamp post; and an LED lamp connecting to the lamp post and comprising:

at least one LED module having a plurality of LEDs, a thermal module being secured to a side of the at least one LED module;

wherein the thermal module comprises a plurality of fins, the fins are stacked with one above another with a gap defined between two adjacent ones, each of the fins defines at least one opening, the openings of the fins coincide with each other from top to bottom so as to form a channel, the channel is used for air to flow therein to exchange heat with the fins; and wherein at least one tab protrudes from the each of the fins and corresponds to the at least one opening; and wherein the at least one tab is formed adjacent to the at least one opening, and two opposite ends of the at least one tab are connected to the each of the fins.

13. The street lamp as claimed in claim 12 further comprising a lamp enclosure, wherein the at least one LED module is received in the lamp enclosure.

14. The street lamp as claimed in claim 12, wherein the thermal module further comprises a base and a plurality of heat pipes, the base is attached to a surface of the at least one LED module, the heat pipes connect the base with the fins.

15. The street lamp as claimed in claim 12 further comprising a cover, wherein the cover has an arced shape, the cover has an outer surface having a convex shape and an internal surface having a concave shape.

16. The street lamp as claimed in claim 12, wherein the air flows upwardly through the openings and impinges on the tabs to flow horizontally along surfaces of the fins.

17. An LED lamp comprising:

a lamp enclosure comprising a connecting portion adapted for connecting with a lamp post and a casing defining a room;

a lens attached to a bottom of the casing;

an LED module received in the room of the casing and having a plurality of LEDs facing the lens;

a metallic base attached to the LED module and in thermal connection therewith;

a plurality of U-shaped heat pipes each having an evaporator soldered to the base and two condensers extending upwardly from the evaporator;

a plurality of fins stacked on each other, wherein a gap is defined between two neighboring fins, the condensers extend through the fins and are soldered thereto, the fins cooperatively define at least a channel extending through all of the fins and communicating a space between the fins and the base and a space above the fins;

wherein each of the fins forms a tab at a position corresponding to the channel, the tab having two opposite ends connecting with the each of the fins, two spaces being defined at two sides of the tab and communicating with the channel.

18. The LED lamp as claimed in claim 17, wherein an air flows upwardly through the channel and impinges on the tabs to flow horizontally along surfaces of the fins.

* * * * *